US011218811B2

(12) United States Patent
Milot et al.

(10) Patent No.: US 11,218,811 B2
(45) Date of Patent: Jan. 4, 2022

(54) LOUDSPEAKER

(71) Applicant: HARMAN INTERNATIONAL INDUSTRIES, INCORPORATED, Stamford, CT (US)

(72) Inventors: Gilles Milot, Paris (FR); Marc-Olivier Chauveau, Saint-Cyr-sur-Loire (FR); Ludovic Fournier, Chateau du Loir (FR); Guenther Weber, Kelheim (DE); Armin Prommersberger, Karlsbad (DE)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 42 days.

(21) Appl. No.: 16/492,444

(22) PCT Filed: Mar. 7, 2018

(86) PCT No.: PCT/US2018/021319
§ 371 (c)(1),
(2) Date: Sep. 9, 2019

(87) PCT Pub. No.: WO2018/165280
PCT Pub. Date: Sep. 13, 2018

(65) Prior Publication Data

US 2020/0045450 A1 Feb. 6, 2020

Related U.S. Application Data

(60) Provisional application No. 62/467,907, filed on Mar. 7, 2017.

(51) Int. Cl.
*H04R 9/04* (2006.01)
*H04R 1/02* (2006.01)
(Continued)

(52) U.S. Cl.
CPC ..... *H04R 9/046* (2013.01); *H04R 1/023* (2013.01); *H04R 9/027* (2013.01); *H04R 9/06* (2013.01)

(58) Field of Classification Search
CPC . H04R 9/00; H04R 9/02; H04R 9/025; H04R 9/04; H04R 9/047; H04R 9/048; H04R 2209/00; H04R 9/024; H04R 9/041
See application file for complete search history.

(56) References Cited

U.S. PATENT DOCUMENTS 4,951,023 A * 8/1990 Erd ..... H04R 9/047 335/222
7,136,501 B2 11/2006 Steere et al.
(Continued)

FOREIGN PATENT DOCUMENTS

CN 105392092 A 3/2009
CN 201995123 U 9/2011
(Continued)

OTHER PUBLICATIONS

International Search Report of PCT/US2018/021319 dated May 6, 2019, 4 pages.
(Continued)

*Primary Examiner* — Walter F Briney, III
(74) *Attorney, Agent, or Firm* — Brooks Kushman P.C.

(57) ABSTRACT

A loudspeaker and method of operating a loudspeaker are provided. The loudspeaker has a motor assembly with at least one planar coil. First and second magnets are magnetized in a magnetized direction perpendicular to a direction of coil movement and perpendicular to a central axis of radiation of the loudspeaker. The central axis of radiation is generally parallel to a direction of coil movement and parallel to the plane of the planar coil. The first and second magnets each have upper and lower large surface faces separated by a narrowest dimension. The first and second
(Continued)

magnets are magnetized across the narrowest dimension in first and second magnetized directions being opposite.

19 Claims, 4 Drawing Sheets

(51) Int. Cl.
*H04R 9/02* (2006.01)
*H04R 9/06* (2006.01)

(56) References Cited

U.S. PATENT DOCUMENTS 8,155,371 B2 * 4/2012 Wu ..... H04R 9/045 381/400
9,100,738 B2 8/2015 Voishvillo et al.
9,942,663 B1 * 4/2018 Salvatti ..... H04R 9/025
10,743,097 B1 * 8/2020 Cho ..... H04R 9/06
2002/0172392 A1 * 11/2002 Iwasa ..... H04R 9/025 381/413
2003/0103642 A1 * 6/2003 Kam ..... H04R 9/043 381/431
2004/0008858 A1 1/2004 Steere
2005/0036648 A1 2/2005 Nguyen et al.
2008/0205686 A1 * 8/2008 Tagami ..... H04R 9/025 381/398
2008/0279414 A1 11/2008 Milot et al.
2009/0028375 A1 1/2009 Richoux et al.
2009/0257617 A1 * 10/2009 Ikeda ..... H04R 9/047 381/410
2012/0051557 A1 3/2012 Horigome et al.
2014/0146995 A1 5/2014 Adelman
2014/0161303 A1 * 6/2014 Kim ..... H04R 9/025 381/401
2014/0219494 A1 * 8/2014 Kim ..... H04R 9/046 381/400
2015/0010195 A1 1/2015 Croft, III
2016/0381462 A1 * 12/2016 Wang ..... H04R 9/025 381/398
2016/0381463 A1 * 12/2016 Wang ..... H04R 9/025 381/400
2016/0381481 A1 * 12/2016 Wang ..... H04R 9/025 381/400
2017/0034628 A1 * 2/2017 Mao ..... H04R 9/025
2017/0034629 A1 * 2/2017 Mao ..... H04R 9/045
2017/0034631 A1 * 2/2017 Wang ..... H04R 9/045
2017/0280247 A1 9/2017 Kobayashi et al.
2017/0289693 A1 * 10/2017 Wang ..... H04R 9/025
2018/0027332 A1 1/2018 Mao et al.
2018/0146294 A1 * 5/2018 Zhu ..... H04R 1/38
2018/0184209 A1 6/2018 Zhu et al.
2018/0220238 A1 * 8/2018 Zhu ..... H04R 9/046
2018/0295451 A1 * 10/2018 Min ..... H05K 3/4614

FOREIGN PATENT DOCUMENTS

CN 104883649 A 9/2015
CN 204993831 U 1/2016
CN 107360525 A 11/2017
DE 2759331 A1 9/1979
DE 102015103339 A1 9/2016
JP S5721200 A 2/1982
JP 2009111484 A 5/2009

OTHER PUBLICATIONS

Written Opinion of PCT/US2018/021319 dated May 6, 2019, 5 pages.
Office Action of Chinese Application No. 201880016122.6 dated Aug. 27, 2020, 9 pages.

* cited by examiner

LOUDSPEAKER

CROSS-REFERENCE TO RELATED APPLICATIONS

This application is the U.S. national phase of international Application No. PCT/US2018/021319 filed Mar. 7, 2018, which claims the benefit of U.S. provisional application Ser. No. 62/467,907 filed Mar. 7, 2017, the disclosures of which are hereby it in their entireties by reference herein.

TECHNICAL FIELD

This application relates loudspeakers having a magnet and a moving-coil electrodynamic motor.

BACKGROUND

An electrodynamic motor in a loudspeaker includes a voice coil and a magnet assembly that generates a constant magnetic field. An alternating current corresponding to electrical signals conveying audio signals is provided to the voice coil. When current flows through the voice coil, the coil interacts with the constant magnetic field and results in movement of the voice coil. This interaction results in the force F, expressed as a product of the magnetic flux density B, the overall length of the voice coil's turns linked to the magnetic flux 1, and the value of the electrical current running through the voice coil I, according to the formula $F=B\cdot I\cdot 1$. Due to the force acting on the voice coil wire positioned in the constant magnetic field, the alternating current actuates the voice coil to moves back and forth and, accordingly, moves the diaphragm to which the voice coil (or coil former) is attached. The reciprocating diaphragm produces acoustic signals that propagate as sound waves through air.

One example of a moving coil loudspeaker is U.S. Pat. No. 9,100,738 by Harman International Industries.

SUMMARY

According to at least one embodiment, a loudspeaker is provided having a motor assembly with at least one planar coil. First and second magnets are magnetized in a magnetized direction perpendicular to a direction of coil movement and perpendicular to a central axis of radiation of the loudspeaker. The central axis of radiation is generally parallel to a direction of coil movement and parallel to the plane of the planar coil.

In another embodiment, the first and second magnets each have upper and lower large surface faces separated by a narrowest dimension. The first and second magnets are magnetized across the narrowest dimension in first and second magnetized directions being opposite. The planar coil is arranged in a plane along at least one of the upper and lower large surface faces, wherein a direction of coil movement is parallel to the plane of the coil.

In another embodiment, the narrowest magnet face dimension is less than five millimeters.

In another embodiment, the planar coil has first and second planar coils. The first and second planar coils are positioned in a plane parallel to and along the upper and lower large surfaces respectively.

In another embodiment, the first and second magnets each include at least two magnets spaced apart in a height direction by an air gap, wherein the height direction is perpendicular to the direction of coil movement and perpendicular to the narrowest magnet face dimension.

In another embodiment, the first and second magnets are arranged in-line between a front grill and a back wall. A depth of the loudspeaker is defined between the front grill and the back wall.

According to at least one other embodiment, a loudspeaker is provided having at least one coil. A first set of magnets is magnetized in a first magnetized direction. A second set of magnets is positioned adjacent the first set of magnets and is magnetized in a second magnetized direction being opposite the first magnetized direction. The first and second magnetized directions are perpendicular to direction of coil movement and perpendicular to an axis of radiation of the loudspeaker. The axis of radiation is generally parallel to the direction of coil movement.

In another embodiment, the loudspeaker has a front grill enclosing the loudspeaker through which the axis of radiation extends. The first and second magnetized directions are generally parallel to the front grill of the loudspeaker.

In another embodiment, the first set of magnets is positioned closer to the grill than the second set of magnets in the direction of coil movement.

In another embodiment, the first and second magnetized directions extend across a narrow magnet face having the narrowest magnet face dimension.

In another embodiment, the coil has first and second coil. The first and second coils are separated by the narrowest magnet face dimension.

In another embodiment, the second set of magnets are arranged adjacent to the first set of magnets in the direction of coil movement.

In another embodiment, the first and second set of magnets each include at least two magnets spaced apart in a height direction by an air gap.

In another embodiment, the loudspeaker has a diaphragm connected to the coil. The diaphragm is positioned closer to the first set of magnets than the second set of magnets.

According to at least one other embodiment, a method of operating a loudspeaker is provided. A motor assembly is provided having first and second magnets. Each of the first and second magnets has upper and lower large surface faces separated by a narrowest dimension. The first and second magnets are magnetized across the narrowest dimension in first and second magnetized directions being opposite. A first coil is positioned along at least one of the upper and lower large surfaces. The first coil is energized and in response, the first coil moves in a direction of coil movement being perpendicular to the first and second magnetized directions.

In another embodiment, the method includes arranging first and second magnets in-line in the direction of coil movement.

In another embodiment, the method includes positioning a second coil along at the other of the upper and lower large surfaces. The first and second coils are energized and in response to energizing, the first and second coils move in the direction of coil movement being perpendicular to the first and second magnetized directions.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Loudspeakers generally include a motor having a magnet. The magnet has two poles that produce a magnetic field between the two poles. A moving coil is formed by turns of conductive coil. When current flows through the coil, the coil is subject to magnetic field and force is generated which results in movement of the coil. When current flows through the coil, the coil is subject to magnetic field and force is generated which results in movement of the coil in accordance with the formula $F=B \cdot I \cdot L$ (where B is the intensity of induction or magnetic field, I is the intensity of current and L is the length of the conductor subject to the magnetic field).

Figure 1:
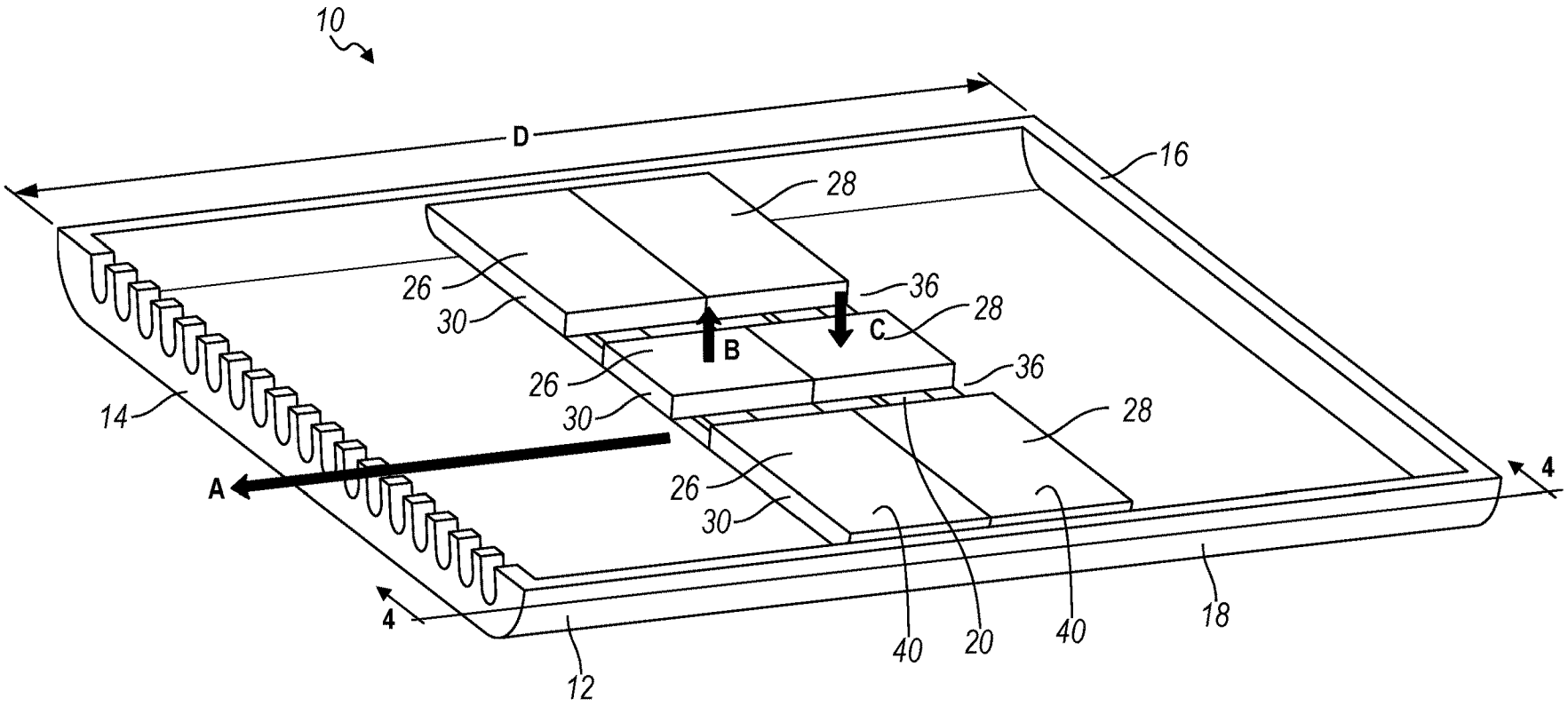
FIG. 1 is a perspective view of a portion of a loudspeaker according to one embodiment.

FIG. 1 illustrates a perspective view of a loudspeaker 10 with a portion of a housing removed in order to view the internal motor and magnet architecture. The housing 12 includes a front grill 14 having a plurality of apertures through which acoustic radiation radiates. The front grill 14 provides protection for other loudspeaker components. The housing 12 also includes a back wall 16 that encloses the rear of the loudspeaker 10. The depth D of the speaker 10 is defined between the front grill 14 and the back wall 16. In one embodiment, the depth D of the loudspeaker 10 may range from 10-25 mm. However other depth dimensions may be possible.

The housing 12 may also have a frame 18 that defines side walls of the loudspeaker 10 and connects the front grill 14 to the back wall 16. As shown in the Figures, the frame 18 may be generally cylindrical and have an elongated oval, or race-track cross section with circular ends connecting elongated sides. In other embodiments, the frame may be elliptical or circular shaped. However, any suitable frame shape may be used.

The loudspeaker 10 includes at least one moving coil 20 connected to a diaphragm 24. The coil 20 moves in direction indicated by arrow A. The direction of movement is generally perpendicular to the front grill 14.

The loudspeaker 10 includes planar magnets that are magnetized in direction being perpendicular to the motion of the coil. As shown in FIG. 1, the loudspeaker 10 has a first magnet 26, or set of magnets. The first magnets 26 are magnetized in a direction B being perpendicular to the direction of coil motion A. The loudspeaker 10 has a second magnet 28, or second set of magnets abutting the first magnets 26 and magnetized in a direction C, opposite direction B and also perpendicular to the direction of coil motion A. The magnets 26, 28 are oriented with the smallest face 30 parallel to the front grill 14 and perpendicular to direction A and the movement of the coil 20.

Figure 2:
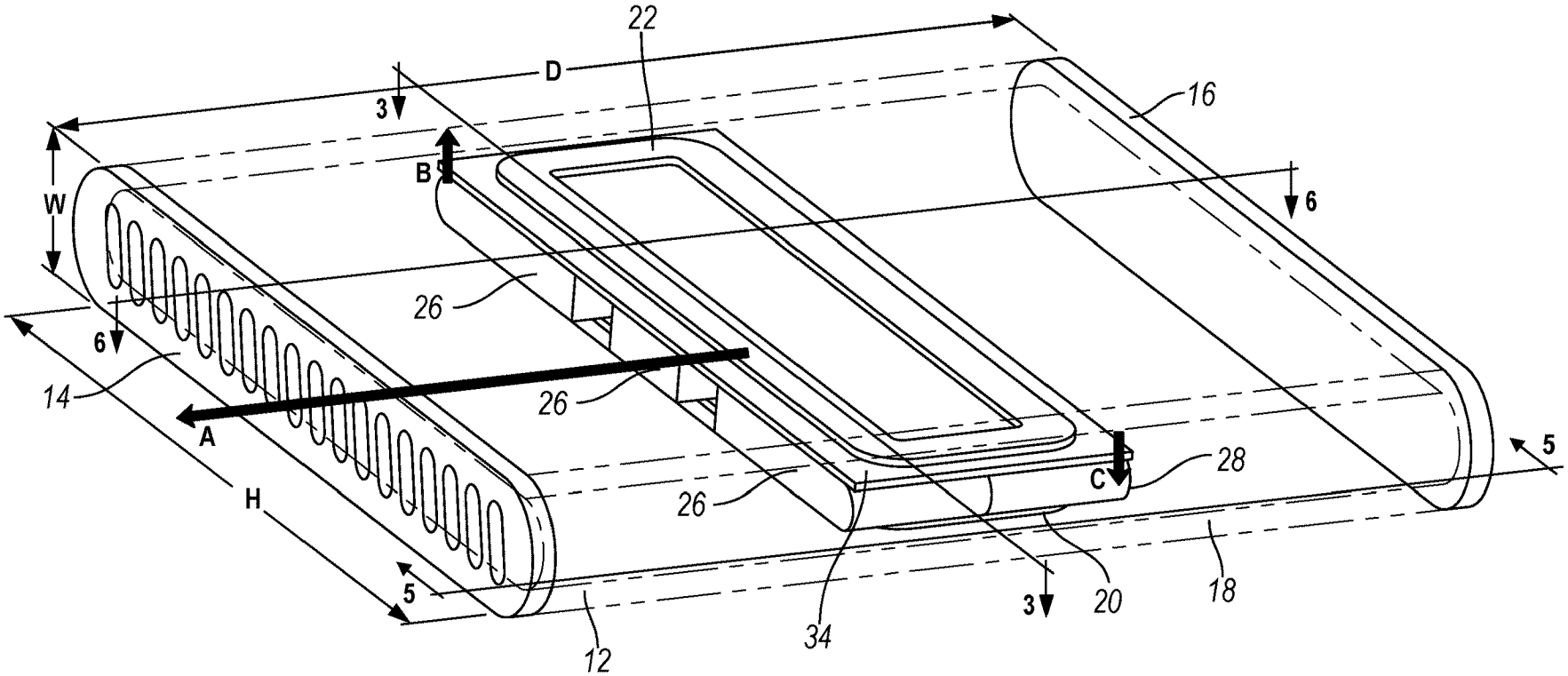
FIG. 2 is another perspective view of a portion of the loudspeaker of FIG. 1.

The loudspeaker 10 may have more than one coil. For example, FIG. 2 illustrates another perspective view of the loudspeaker 10, similar to FIG. 1 but where two moving coils 20 are shown. A first coil 20 is positioned on one side of the magnets 26, 28 and a second coil 22 is positioned on an opposite side of the magnets 26, 28.

Figure 3:
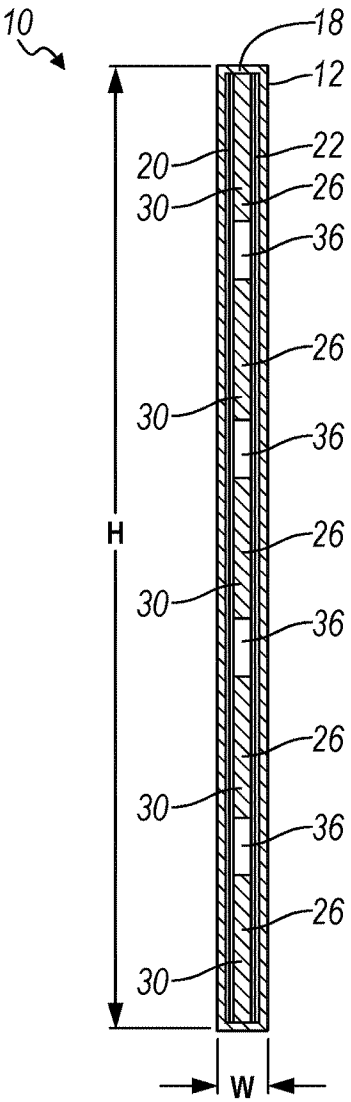
FIG. 3 is a cross-section view of the loudspeaker through section 3-3 of Figure of FIG. 2.

FIG. 3 is a cross-section view of the loudspeaker 10 through section 3-3 of Figure of FIG. 2. As shown in FIG. 3, the magnets 26, 28 are positioned between the two coils 20, 22. The speaker has a narrow width W since the coils are separated by the smallest dimension 30 of the magnets 26, 28. The width W of the speaker, and consequently the grill opening 14, may be approximately 3 mm. The speaker 10 and grill opening 14 may have a height H defined between the side walls being approximately 30 mm to 60 mm. The width W and height H may be other suitable dimensions based on speaker characteristics.

Figure 4:
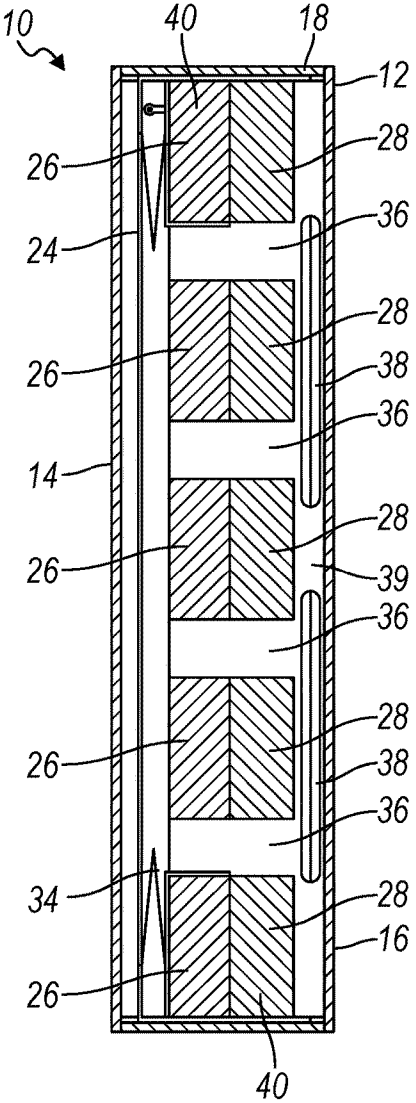
FIG. 4 is a cross-section view of the loudspeaker through section 4-4 of Figure of FIG. 2 showing a top view of the magnets.

FIG. 4 is a cross-section view of the loudspeaker 10 through section 4-4 of Figure of FIG. 1 showing a top view of the magnets 26, 28 and the loudspeaker 10. The diaphragm 24 is connected to the coils through a former 34 (the coils are not shown in this view). In order to covert force moving the coil 20, 22 into an acoustic pressure wave, the diaphragm 24 is connected and can move the air with the enclosure.

The spaces 36 between the magnets 26, 28 allow for air flow as the coils 20, 22 and diaphragm 24 move. The first magnets 26 are positioned parallel and closer to the diaphragm 24. The second magnets 28 are positioned adjacent to the magnets 26 and closer to the back wall 16.

Figure 5:
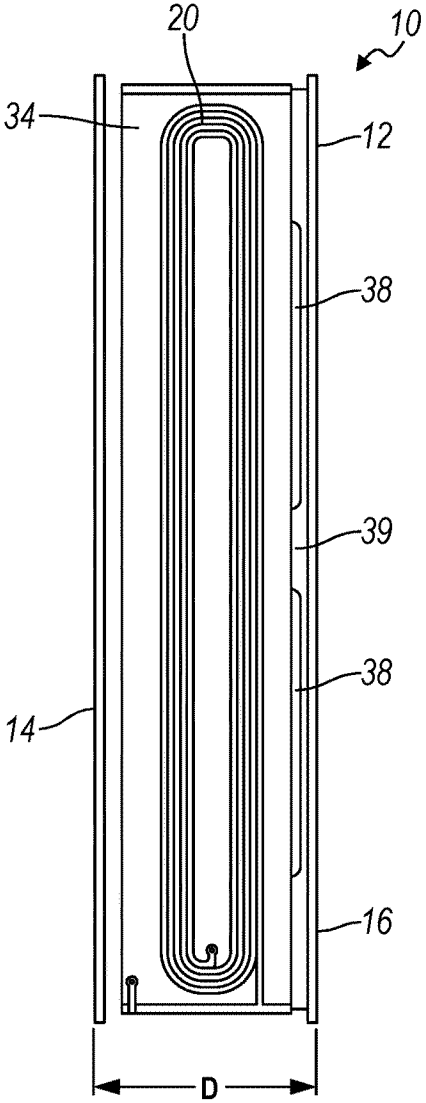
FIG. 5 is a cross-section view of the loudspeaker through section 5-5 of Figure of FIG. 2 showing a top view of the coil.

FIG. 5 is a cross-section view of the loudspeaker 10 through section 5-5 of Figure of FIG. 2 showing a top view of one coil 20. The coils 20, 22 are planar coils oriented parallel to the largest surface 40, 44 of the magnets in order to optimize magnet efficiency since the efficiency of neodymium magnets depends on the surface area. This configuration of magnets and coils also optimizes the force factor (BL factor) for a thin loudspeaker and improves that sound pressure level (SPL) for the same sized driver.

Figure 6:
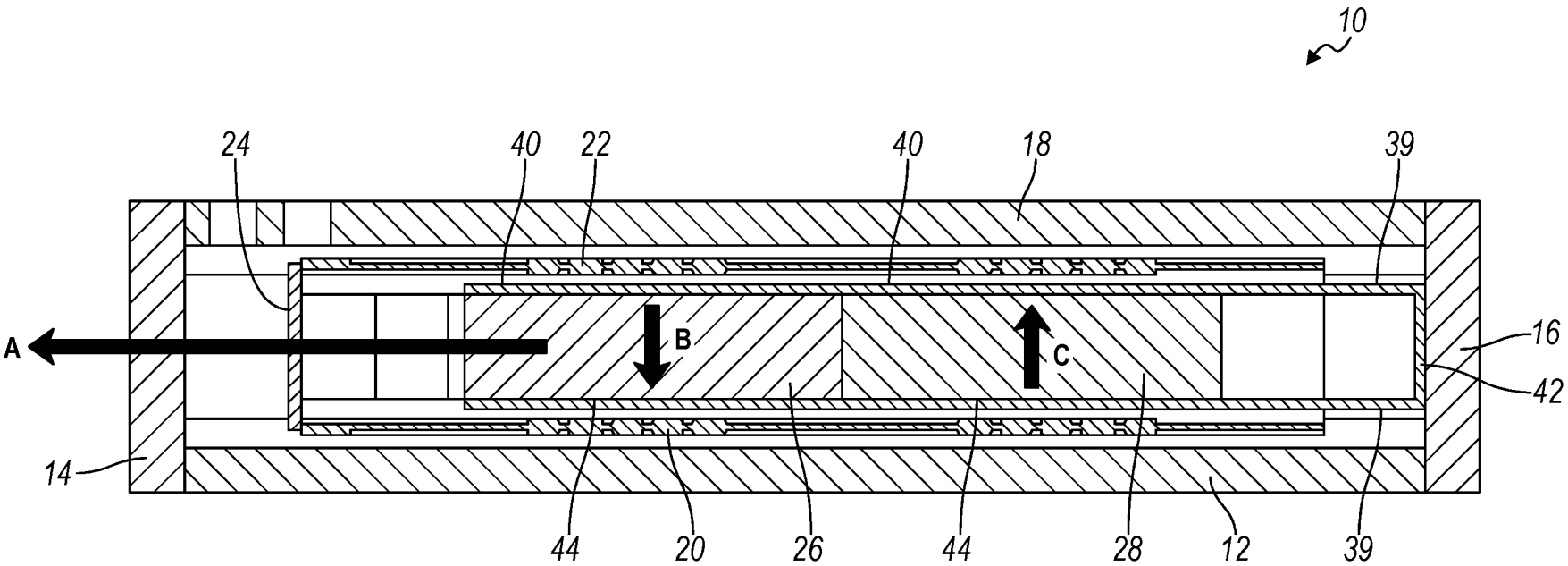
FIG. 6 is a side cross-section view of the loudspeaker through section 6-6 of Figure of FIG. 2.

FIG. 6 is a side cross-section view of the loudspeaker 10 through section 6-6 of Figure of FIG. 2. As shown in FIG. 6, the magnets 26, 28 are sandwiched between pole pieces 39. As shown in FIG. 6, the pole piece 39 may be a continuous yoke the extends from a first face 40 of the magnets 26, 28 to a back connecting plate 42 adjacent the back wall 16 and then extends along a second face 44 of the magnets 26, 28. The pole piece 39 is generally formed of iron or low carbon content steel. The pole piece 39 may have openings 38 for therein which provide air flow.

The speaker 10 may have coils 20, 22 positioned on each side of the magnets 26, 28. The coils 20, 22 are positioned outboard of the pole pieces 39. In another embodiment, the speaker 10 may only have one coil 20 disposed on one side of the magnets 26, 28. The coils 20, 22 are connected to the diaphragm 24 and move in a direction A. In another embodiment, it is possible to have more than one or multiple coils 20, 22 positioned on one side or both side of the magnet 26, 28.

As shown in FIG. 6, the first magnets 26 are magnetized in a direction B being perpendicular to the direction of coil motion A. The second magnets 28 are magnetized in a direction C, opposite direction B and also perpendicular to the direction of coil motion A. The magnets 26, 28 are magnetized in a direction between the largest faces 40, 44. The magnets 26, 28 are magnetized across the smallest dimension 30.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A loudspeaker comprising:

a motor assembly having at least one planar coil; and first and second magnets magnetized in a magnetized direction perpendicular to a direction of coil movement and perpendicular to a central axis of radiation of the loudspeaker, wherein the first and second magnets each include at least two magnets spaced apart in a height direction by an air gap not containing the planar coil, wherein the height direction is perpendicular to the direction of coil movement and perpendicular to the narrowest magnet dimension; and wherein the central axis of radiation is generally parallel to a direction of coil movement and parallel to the plane of the planar coil.

2. The loudspeaker of claim 1 wherein the first and second magnets each have upper and lower large surface faces separated by a narrowest dimension, wherein the first and second magnets are magnetized across the narrowest dimension in first and second magnetized directions being opposite, wherein the at least one planar coil is arranged in a plane along at least one of the upper and lower large surface faces, wherein a direction of coil movement is parallel to the plane of the coil.

3. The loudspeaker of claim 2, wherein the narrowest dimension is less than five millimeters.

4. The loudspeaker of claim 2, wherein the at least one planar coil comprises first and second planar coils, wherein the first and second planar coils are positioned in a plane parallel to and along the upper and lower large surfaces respectively.

5. The loudspeaker of claim 1, wherein the first and second magnets are arranged in-line between a front grill and a back wall, wherein a depth of the loudspeaker is defined between the front grill and the back wall.

6. A loudspeaker comprising:

a first set of magnets magnetized in a first magnetized direction;

a second set of magnets positioned adjacent the first set of magnets and magnetized in a second magnetized direction being opposite the first magnetized direction; and first and second coils separated by the narrowest magnet face dimension, wherein the first and second magnetized directions are perpendicular to direction of coil movement and perpendicular to an axis of radiation of the loudspeaker, wherein the axis of radiation is generally parallel to the direction of coil movement.

7. The loudspeaker of claim 6, further comprising a front grill of the loudspeaker enclosing the loudspeaker through which the axis of radiation extends, wherein the first and second magnetized directions are generally parallel to the front grill of the loudspeaker.

8. The loudspeaker of claim 7, wherein the first set of magnets is positioned closer to the grill than the second set of magnets in the direction of coil movement.

9. The loudspeaker of claim 6, wherein the first and second magnetized directions extend across a narrow magnet face having the narrowest magnet face dimension.

10. The loudspeaker of claim 9, wherein the narrowest magnet face dimension is less than five millimeters.

11. The loudspeaker of claim 6, wherein the first and second magnets each have upper and lower large surface faces separated by a narrowest dimension wherein the first coil is positioned along the upper large surfaces and the second coil is positioned along the lower large surfaces.

12. The loudspeaker of claim 6, wherein the second set of magnets are arranged adjacent to the first set of magnets in the direction of coil movement.

13. The loudspeaker of claim 6, wherein the first and second set of magnets each include at least two magnets spaced apart in a height direction by an air gap.

14. The loudspeaker of claim 6, wherein the first set of magnets are arranged in-line with the second set of magnets between a front grill and a back wall, wherein a depth of the loudspeaker is defined between the front grill and the back wall.

15. The loudspeaker of claim 6, further comprising a diaphragm connected to the coil, wherein the diaphragm is positioned closer to the first set of magnets than the second set of magnets.

16. A method of operating a loudspeaker comprising:

providing a motor assembly having first and second sets of magnets each having upper and lower large surface faces separated by a narrowest dimension, wherein the first and second sets of magnets are magnetized across the narrowest dimension in first and second magnetized directions being opposite, wherein the first and second sets of magnets each include at least two magnets spaced apart in a height direction by an air gap;

positioning a first coil along at least one of the upper and lower large surfaces;

energizing the first coil, wherein in response to energizing, the first coil moves in a direction of coil movement being perpendicular to the first and second magnetized directions.

17. The method of claim 16, further comprising arranging the first and second magnets in-line in the direction of coil movement.

18. The method of claim 16, wherein the narrowest dimension is less than five millimeters.

19. The method of claim 16, further comprising:

positioning a second coil along at the other of the upper and lower large surfaces; and energizing the first and second coils, wherein in response to energizing, the first and second coils move in the direction of coil movement being perpendicular to the first and second magnetized directions.

* * * * *